US008157169B2

(12) United States Patent
Olden et al.

(10) Patent No.: US 8,157,169 B2
(45) Date of Patent: Apr. 17, 2012

(54) PROJECTILE TARGETING SYSTEM

(75) Inventors: Thomas A. Olden, Tucson, AZ (US); Robert P. Johnson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 309 days.

(21) Appl. No.: 12/610,498

(22) Filed: Nov. 2, 2009

(65) Prior Publication Data

US 2011/0101097 A1 May 5, 2011

(51) Int. Cl.
*G06F 19/00* (2006.01)
*G06G 7/00* (2006.01)

(52) U.S. Cl. ..... 235/404; 235/375; 89/41.03

(58) Field of Classification Search ..... 235/400–418; 89/1.7–1.11, 41.03
See application file for complete search history.

(56) References Cited

U.S. PATENT DOCUMENTS

| | | | | |
|---|---|---|---|---|
| 4,794,235 | A | 12/1988 | Burke et al. | |
| 6,626,077 | B1 | 9/2003 | Gilbert | |
| 7,500,423 | B2 * | 3/2009 | Strand | 89/41.03 |
| 2003/0010185 | A1 | 1/2003 | O'Dwyer | |
| 2008/0110986 | A1 | 5/2008 | Quinn | |
| 2008/0127598 | A1 | 6/2008 | Kallstrom | |
| 2009/0212108 | A1 * | 8/2009 | Rothe et al. | 235/404 |
| 2009/0266226 | A1 | 10/2009 | Beach et al. | |
| 2009/0266892 | A1 * | 10/2009 | Windauer et al. | 235/404 |
| 2011/0129657 | A1 | 6/2011 | Clough | |

FOREIGN PATENT DOCUMENTS

| | | | |
|---|---|---|---|
| WO | WO-2011096916 | A2 | 8/2011 |
| WO | WO-2011096916 | A3 | 8/2011 |

OTHER PUBLICATIONS

"U.S. Appl. No. 12/566,311, Restriction Requirement mailed Sep. 9, 2011", 5 pgs.
"U.S. Appl. No. PCT/US2010/02849, Written Opinion mailed Aug. 5, 2011", 7 pgs.
"International Application Serial No. PCT/US2010/02849, International Search Report mailed Aug. 5, 2011", 2 pgs.
"U.S. Appl. No. 12/556,311, Non Final Office Action mailed Nov. 2, 2011", 9 pgs.

* cited by examiner

*Primary Examiner* — Edwyn Labaze
(74) *Attorney, Agent, or Firm* — Schwegman, Lundberg & Woessner, P.A.

(57) ABSTRACT

In an example embodiment, a method of identifying a firing solution to a target is provided. In this method, an elevation of the target and a height of the target relative to an initial height of the projectile are sensed. A clear line of sight from the projectile to the target is also sensed. Based on the elevation, the height, and the clear line of sight, an acceptable firing solution is identified. An signal indicating that the projectile can be launched can then be initiated based on the identification of the acceptable firing solution.

20 Claims, 7 Drawing Sheets

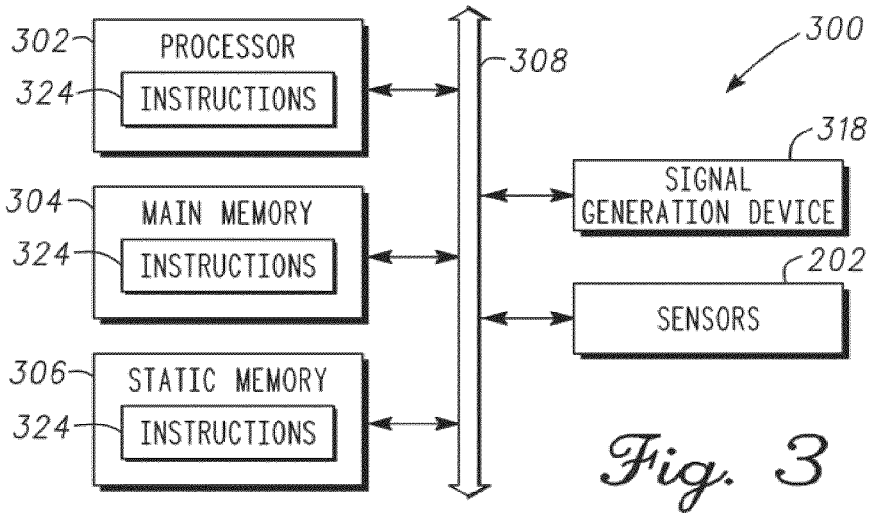
Fig. 3
Fig. 4
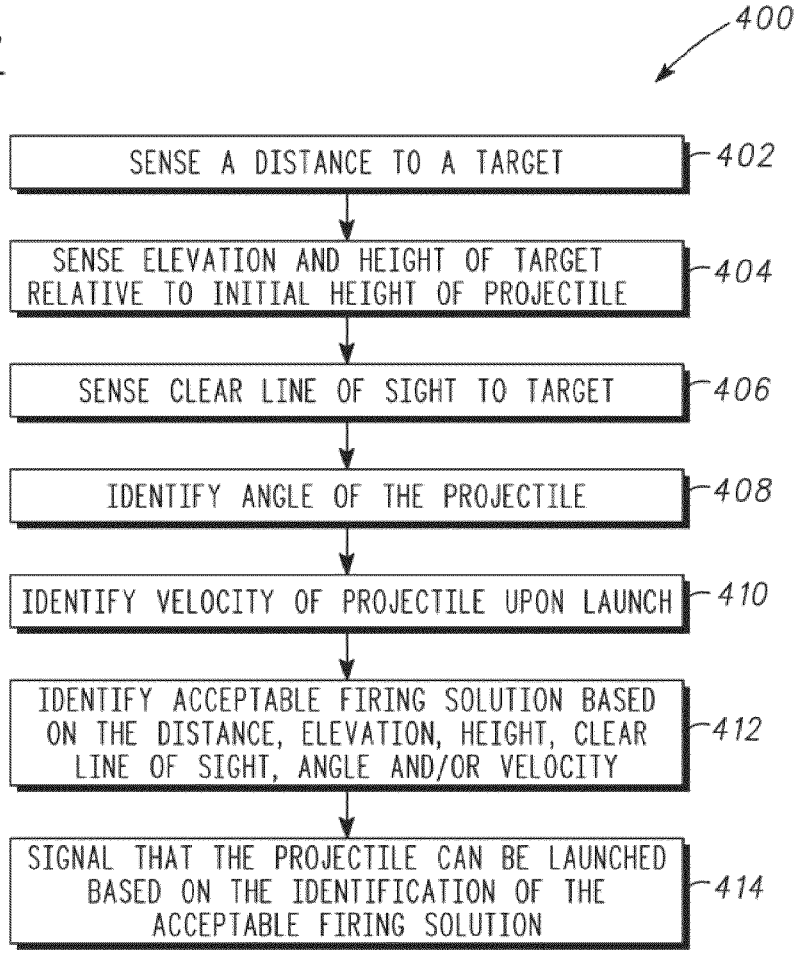

PROJECTILE TARGETING SYSTEM

FIELD

The present disclosure relates generally to target acquisition. In an example embodiment, the disclosure relates to projectile targeting systems.

BACKGROUND

A handheld rocket launcher is a weapon that fires a projectile and is small enough to be carried by a single person. Many of these rocket launchers fire unguided projectiles. To aim the handheld rocket launcher, an operator may use a sighting device to aim or direct the projectile at a target. For example, the sighting device can be used to assist aiming by aligning an eye of the operator with the handheld rocket launcher to be pointed. Examples of sighting devices include iron sights, reflex sights, peep sights, telescopic sights, and other sighting devices. However, it should be appreciated that aiming with these sighting devices can be inaccurate and, as a result, the operator must fire relatively close to the intended target, increasing his chances of being spotted.

SUMMARY

In an embodiment, a method of identifying a firing solution to a target is provided. In this method, an elevation of the target and a height of the target relative to an initial height of the projectile are sensed. A clear line of sight from the projectile to the target is also sensed. Based on at least the elevation, the height, and/or the clear line of sight, an acceptable firing solution is identified. A signal indicating that the projectile can be launched can then be initiated based on the identification of the acceptable firing solution.

In another embodiment, a projectile launching apparatus is provided. The projectile launching apparatus includes a sabot and a targeting system coupled to the sabot. The targeting system includes a sensor configured to sense at least an elevation of the target relative to an initial height of the projectile, a height of the target relative to the initial height, and a line of sight from the projectile to the target. The targeting system also includes a safe-to-fire calculation module in communication with the sensor. This safe-to-fire calculation module is configured to identify an acceptable firing solution based on the elevation, the height, and the line of sight, and to signal that the projectile can be launched based on the identification of the acceptable firing solution.

In yet another embodiment, a targeting system is provided that includes at least one processor and a sensor in communication with the processor. The sensor is configured to sense an elevation of the target relative to an initial height of the projectile, a height of the target relative to the initial height, and a line of sight from the projectile to the target. The targeting system also includes a memory in communication with the processor. The memory is configured to store a safe-to-fire calculation module that is executable by the processor. This safe-to-fire calculation module has instructions that when executed by the at least one processor, cause operations to be performed. These operations comprise identifying an acceptable firing solution based on at least the elevation, the height, and the line of sight, and signaling that the projectile can be launched based on the identification of the acceptable firing solution.

BRIEF DESCRIPTION OF DRAWINGS

The present disclosure is illustrated by way of example and not limitation in the figures of the accompanying drawings, in which like references indicate similar elements and in which:

FIG. 3 depicts a block diagram of a machine in the example form of a targeting system, in accordance with an alternate embodiment, within which may be executed a set of instructions for causing the machine to perform any one or more of the methodologies discussed herein;

FIG. 4 depicts a flow diagram of a general overview of a method, in accordance with an embodiment, for identifying a firing solution to the target;

DETAILED DESCRIPTION

The description that follows includes illustrative systems, methods, techniques, instruction sequences, and computing machine program products that embody illustrative embodiments of the present invention. In the following description, for purposes of explanation, numerous specific details are set forth in order to provide an understanding of various embodiments of the inventive subject matter. It will be evident, however, to those skilled in the art that embodiments of the inventive subject matter may be practiced without these specific details. In general, well-known instruction instances, protocols, structures and techniques have not been shown in detail.

Figure 1:
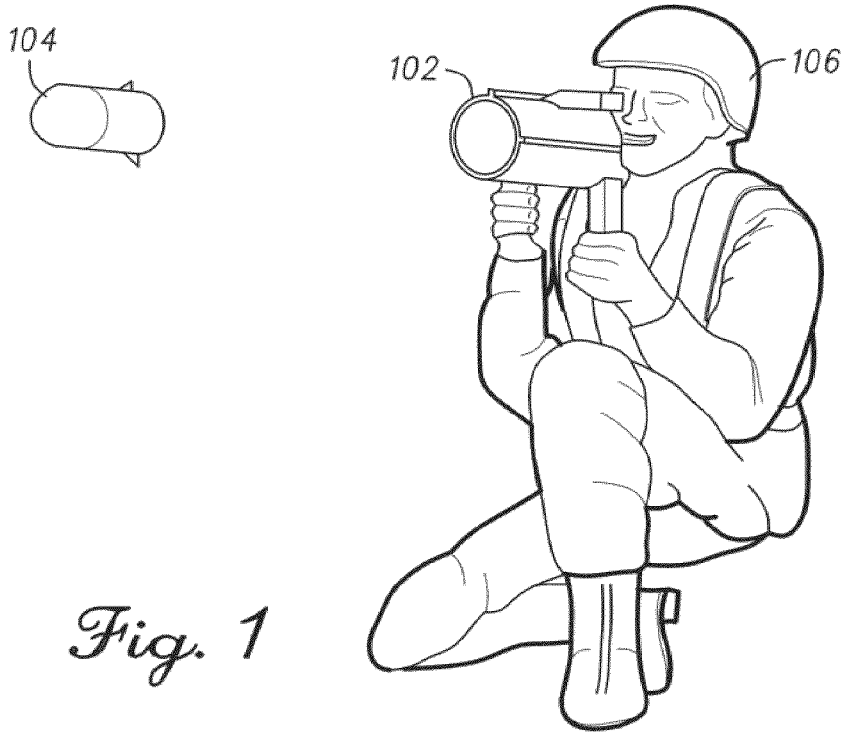
FIG. 1 depicts an operator aiming a projectile launching apparatus with use of a targeting system, consistent with an embodiment of the present invention.

FIG. 1 depicts an operator aiming a projectile launching apparatus 102 with use of a targeting system, consistent with an embodiment of the present invention. In this example, the projectile launching apparatus 102 is a rocket launcher. An operator 106 holding the projectile launching apparatus 102 initially identifies a target and points the projectile launching apparatus 102 in the general direction of the target. A targeting system included in the projectile launching apparatus 102 senses or detects various measurements regarding the target and signals to the operator 106 whether a rocket 104 can or cannot be launched based on these measurements. For example, the targeting system can sense a distance to the target and a height of the target. Additionally, as explained in more detail below, the targeting system can sense other objects within the vicinity of the target. With measurements of the target and other objects within its vicinity, the targeting system can identify or project whether the rocket 104 will hit or miss the target and accordingly, signal to the operator 106 that the rocket 104 can or cannot be launched, respectively.

Figure 2:
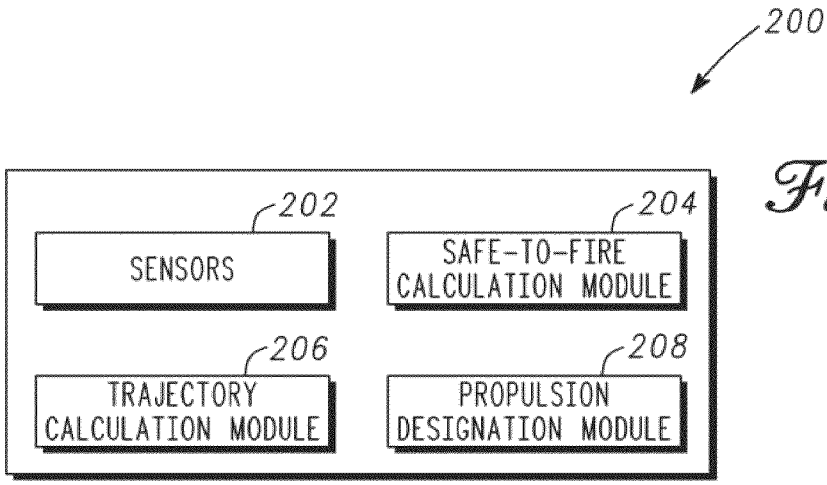
FIG. 2 depicts a block diagram of the various modules that comprise a targeting system, in accordance with an example embodiment, included in a projectile launching apparatus.

FIG. 2 depicts a block diagram of the various modules that comprise a targeting system 200, in accordance with an example embodiment, included in a projectile launching apparatus. The targeting system 200 may, for example, be included in or form a part of the projectile launching apparatus 102 depicted in FIG. 1. Referring to FIG. 2, in various embodiments, the targeting system 200 may be used to implement computer programs, logic, applications, methods, processes, or software to identify a firing solution to a target, as described in more detail below.

As depicted, the targeting system 200 includes sensors 202, a safe-to-fire calculation module 204, a trajectory calculation module 206, and a propulsion designation module 208. The sensors 202 are configured to sense a variety of physical phenomena or properties associated with one or more targets, and other objects within vicinities of the targets. For example, the sensors 202 may include a proximity sensor that can detect a presence of a target, distance to the target, elevation of the target, and/or eight of the target by emitting an electromagnetic field or a beam of electromagnetic radiation (e.g., infrared and radar), and detecting changes in the field or return signal. The height of a target refers to a distance between the lowest and highest points of a target. On the other hand, the "elevation," as used herein, refers to a height to which the target is elevated above a point of reference, such as the targeting system or the ground. In another example, the sensors 202 may include a video camera that can optically detect, for example, presence of a target, distance to the target, and/or height of the target.

The trajectory calculation module 206 is configured to calculate a trajectory of a projectile based on the measurements received from the sensors 202. Additionally, the trajectory calculation module 206 can identify an angle of the projectile before launch. As used here, this angle refers to an amount of rotation or pivot of the projectile relative to, for example, the ground before the projectile is launched.

The propulsion designation module 208 is configured to designate or select a propulsion used to propel the projectile from the projectile launching apparatus. It should be appreciated that in some examples, a projectile does not provide its own thrust. Instead, the projectile launching apparatus pushes the projectile out of the projectile launching apparatus. The projectile launching apparatus can use a variety of different mechanisms to generate a force that pushes the projectile out of the projectile launching apparatus. For example, the projectile launching apparatus may include a set of explosives that, upon explosion, generates such force. In another example, the projectile launching apparatus may include a gas generator that generates compressed gas, the release of which generates the force to push the projectile out of the projectile launching apparatus. The propulsion designation module 208 can identify the propulsion system impulse applied to the projectile based, in part, on the distance. For example, the propulsion designation module 208 may select an appropriate amount of explosive to apply or gas for release based, in part, on the distance to the target. From the identification, the propulsion designation module 208 can identify or derive the velocity of the projectile upon launch.

The safe-to-fire calculation module 204 gathers all the information and measurements from the sensors 202, the trajectory calculation module 206, and the propulsion designation module 208, and calculates or identifies a firing solution based on the information and measurements, as explained in detail below. If an acceptable firing solution is identified, the safe-to-fire calculation module 204 signals to an operator that the projectile can be launched. On the other hand, if an unacceptable fire solution is identified, the safe-to-fire calculation module 204 signals to the operator that the projectile cannot be fired.

It should be appreciated that in other embodiments, the targeting system 200 may include fewer, more, or different modules apart from those shown in FIG. 2. For example, in an alternate embodiment, the targeting system 200 may not include the trajectory calculation module 206 because the safe-to-fire calculation module 204 may not need the trajectory when calculating the firing solution. In yet another embodiment, the targeting system 200 may not include the propulsion designation module 208 because the projectile launching apparatus may use a self-propelled projectile and, as a result, the velocity of the projectile upon launch is predefined.

FIG. 3 depicts a block diagram of a machine in the example form of a targeting system 300, in accordance with an alternate embodiment, within which may be executed a set of instructions for causing the machine to perform any one or more of the methodologies discussed herein. The machine is capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example of the targeting system 300 includes processor 302 (e.g., a central processing unit (CPU)), main memory 304 (e.g., random access memory (a type of volatile memory)), static memory 306 (e.g., static random access memory (a type of volatile memory)), sensors 202, and signal generation device 318 (e.g., speaker or light), which communicate with each other via bus 308. The main memory 304 and the static memory 306 are examples of machine-readable mediums on which one or more sets of data structures and instructions 324 (e.g., software) embodying or utilizing any one or more of the methodologies or functions described herein are completely or partially stored. For example, the instructions 304 may include algorithms used to calculate a firing solution to a particular target.

FIG. 4 depicts a flow diagram of a general overview of a method 400, in accordance with an embodiment, for identifying a firing solution to the target. In one example embodiment, the method 400 may be implemented by the various modules 204, 206, and 208 and sensors 202 that are employed in the targeting system 200 depicted in FIG. 2. Referring to FIG. 4, the targeting system senses a distance from a projectile (or the targeting system itself) to a target at 402. At the same time, the targeting system senses an elevation and height of the target relative to an initial height of the projectile (or the targeting system itself) at 404.

The targeting system also senses a clear line of sight to the target at 406. The targeting system senses that a line of sight to the target is clear if other objects are not blocking the line of sight to the target. For example, if the targeting system senses another object blocking the target, then the line of sight is not clear. On the other hand, if the targeting system does not sense any object blocking the target, then the line of sight is clear. As explained in more detail below, in an alternate embodiment, a clear line of sight can additionally be based on predicted movements of objects within the vicinity of the target.

The targeting system then identifies an angle of the projectile at 408. Some projectile launching apparatuses can automatically pivot to an optimal angle for launching the projectile based on, for example, an optimal trajectory calculated by the targeting system. With a handheld projectile launching apparatus, an operator holding the apparatus manually pivots the apparatus. As a result, the targeting system in the handheld projectile launching apparatus may include a sensor (e.g., a gyroscope and/or accelerometer) that senses the angle of the projectile.

In addition to the angle, the targeting system may also identify a velocity of the projectile upon launch at 410. With self-propelled projectiles, the velocity is predefined, as explained above. On the other hand, with projectiles that are not self-propelled, the targeting system may select an appropriate propulsion system impulse to be applied to the projectile, as also explained above. The velocity can be identified based on this selection.

Still referring to FIG. 4, the targeting system then identifies an acceptable firing solution at 412 based on the various measurements and information described above. As used herein, a "firing solution" refers to the calculated directions of the projectile launching apparatus to launch and strike the projectile. For example, in an embodiment, the targeting system can identify a firing solution based on the distance, elevation of the target, height of the target, clear line of sight to the target, the angle of the projectile, and/or the velocity of the projectile. The targeting system can identify an acceptable firing solution based on a variety of different algorithms. In one embodiment, the algorithms may be implemented in the form of a lookup table, which is explained in more detail below.

With an acceptable firing solution identified, the targeting system then signals at 414 to the operator that the projectile can be launched. However, if the firing solution is identified as unacceptable, then the targeting system signals to the operator that the projectile cannot be launched. The signal may be in the form of audio or visual signals. For example, the targeting system may emit a beep through a speaker when an acceptable firing solution is identified. In another example, the targeting system may emit light through a light emitting diode when an acceptable firing solution is identified.

Figure 5:
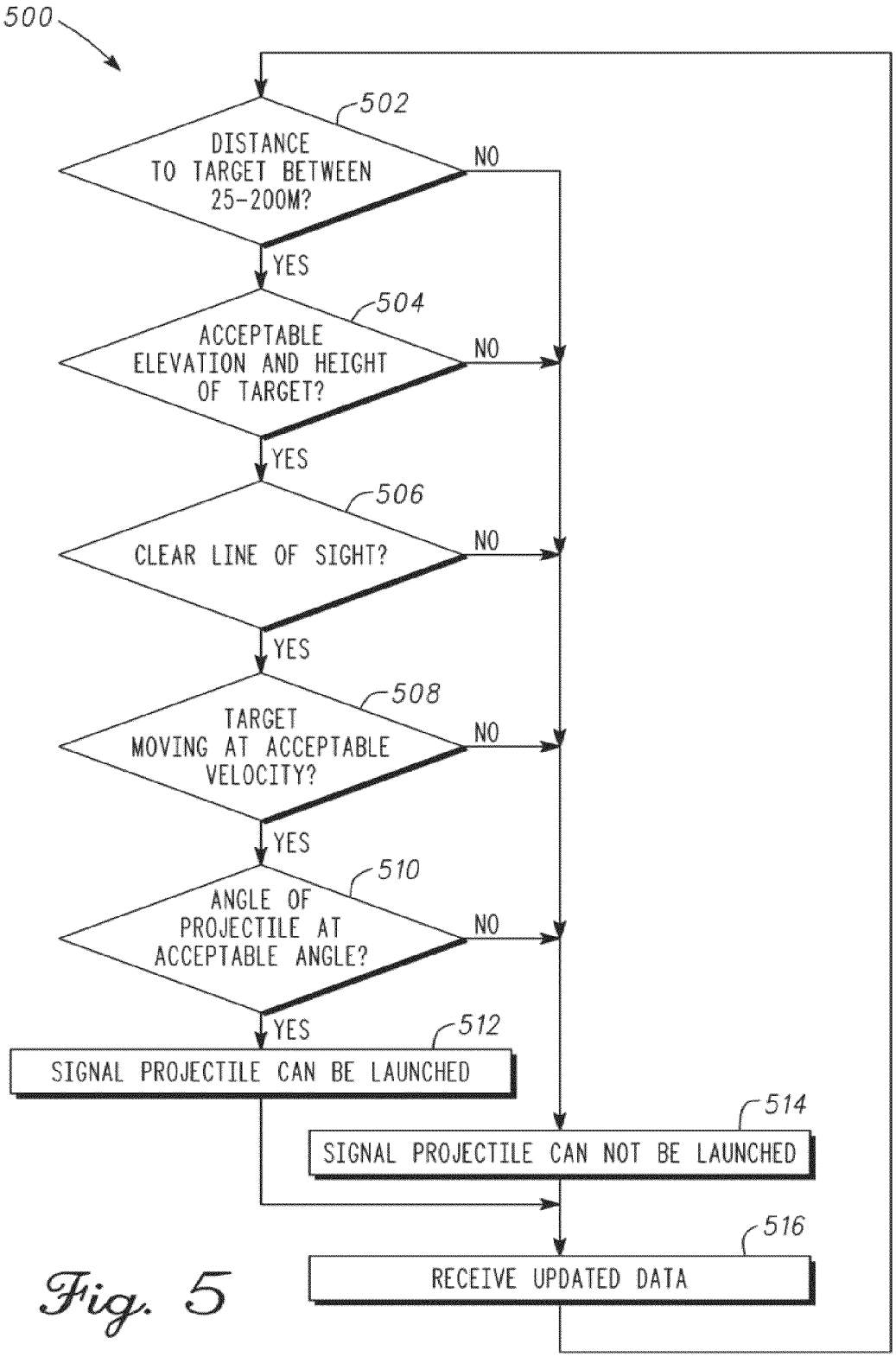
FIG. 5 depicts a flow diagram of a detailed method, in accordance with an embodiment, for identifying whether a firing solution is acceptable.

FIG. 5 depicts a flow diagram of a detailed method 500, in accordance with an embodiment, for identifying whether a firing solution is acceptable. Again, in one example embodiment, the method 500 may be implemented by the various modules 204, 206, and 208 and sensors 202 that are employed in the targeting system 200 depicted in FIG. 2. Referring to FIG. 5, a safe-to-fire calculation module of the targeting system, for example, receives at 516 various measurements and information from various modules and sensors. As noted above, examples of such measurements and information include distance to target, elevation of the target, height of the target, information identifying whether a line of sight is clear or not clear, angle of the projectile, and velocity of the target.

The safe-to-fire calculation module then checks to determine whether the target is beyond the range of the projectile or too close to launch the projectile. For example, as depicted at 502, the safe-to-fire calculation module can check whether the distance to the target is between, for example, about 25 to about 200 meters. As used herein, the term "about" means that the specified dimension or parameter may be varied within an acceptable tolerance for a given application. In some embodiments, the acceptable tolerance is ±10%. A distance of over about 200 meters may be out of the range of the projectile while a distance of less than about 25 meters may be too close for the projectile to launch or be effective. If the distance is not between about 25 to about 200 meters, then the safe-to-fire calculation module signals to an operator of the projectile launching apparatus at 514 that the firing solution is unacceptable and therefore, the projectile cannot be launched. On the other hand, if the distance is between about 25 to about 200 meters, then the safe-to-fire calculation module may then conduct another check at 504.

At 504, the safe-to-fire calculation module checks whether the elevation and the height of the target are acceptable. It should be appreciated that different projectile launching apparatuses may be designed to strike different targets. In one example, the projectile launching apparatus may be designed to strike ground-based targets only and not airborne targets. As a result, for example, if the safe-to-fire calculation module identifies an altitude of the target being above 10,000 feet, then the safe-to-fire calculation module may identify that the elevation is not acceptable. In addition, the projectile launching apparatus may be designed to strike small targets, like people or vehicles. In this example, if the safe-to-fire calculation module identifies that the target has a height of, for example, less than 10 feet, then the safe-to-fire calculation module may identify the height to be acceptable. However, if the height is identified as being greater than 10 feet, then the safe-to-fire calculation module may identify the height of the target as unacceptable and therefore, may signal that the projectile cannot be launched at 514, as discussed above.

If the elevation and height of the target are identified to be acceptable, then the safe-to-fire calculation module may additionally check at 506 whether a line of sight is clear or not clear. In one embodiment, as explained above, a line of sight is clear if no objects are blocking the target. In an alternate embodiment, the targeting system can also predict whether objects within a vicinity of the target will move into the line of sight, and the identification of whether the line of sight is clear or not clear can be based on such prediction, as explained in more detail below. If the line of sight is not clear, then the safe-to-fire calculation module signals that the projectile cannot be launched at 514, as discussed above. It should be appreciated that in yet another embodiment, the safe-to-fire calculation module may also allow the projectile to be fired even if the line of sight is not clear. For example, the target may be lit by a laser designator from a different source, such as another person with a clear line of sight to the target. Upon launch, the projectile is configured to fly over the blocking object and thereafter, seek the target based the laser radiation from this different source.

If the line of sight is clear, then the safe-to-fire calculation module checks whether the target is moving at an acceptable velocity at 508, in accordance with an embodiment. Here, the projectile launching apparatus may be designed to strike specifically certain slow-moving targets and not fast moving targets. In this example, an acceptable velocity of the target may range from about 0 miles/hour to about 40 miles/hour. If the target is identified as moving at an unacceptable velocity, then the safe-to-fire calculation module signals that the projectile cannot be launched at 514, as discussed above.

Still referring to FIG. 5, if the target is moving at an acceptable velocity, then the safe-to-fire calculation module checks at 510 whether the angle of projectile is at an acceptable angle. For example, if the operator is holding the projectile launching apparatus at an angle that is different from an angle derived from the calculated trajectory, then the safe-to-fire calculation module may signal that the projectile cannot be launched at 514, as discussed above. On the other hand, if the operator is holding the projectile launching apparatus at an angle that is substantially the same as the angle derived from the calculated trajectory, then the safe-to-fire calculation module signals to the operator that the projectile can be launched at 512.

After the safe-to-fire calculation module identifies that the projectile can or cannot be launched, the safe-to-fire calculation module receives updated measurements and information at 516 from the various modules and sensors and repeats the same checks 502, 504, 506, 508, and 510. As a result, the targeting system is a closed loop system where measurements and other information associated with the target are continuously updated. Thus, the safe-to-fire calculation module is continuously calculating or identifying a firing solution. In one embodiment, the safe-to-fire calculation module can be configured to not launch the projectile when it identifies an unacceptable firing solution, even when the operator pulls, for example, a trigger on the projectile launching apparatus to launch the projectile. In this example, the projectile launching apparatus may have a manual override mechanism that the operator can activate if he still wants to launch the projectile. In an alternate embodiment, the safe-to-fire calculation module is configured to signal whether the projectile can be launched, and cannot prevent the projectile from being launched.

It should be appreciated that the method 500 may be implemented in the form of a lookup table that stores the various ranges and conditions associated with, for example, the checks associated with 502, 504, 506, 508, and/or 510. For example, the lookup table may include a column identifying each measurement (e.g., distance, elevation, and height), and include the various acceptable or unacceptable ranges stored along rows of the lookup table.

Figure 6:
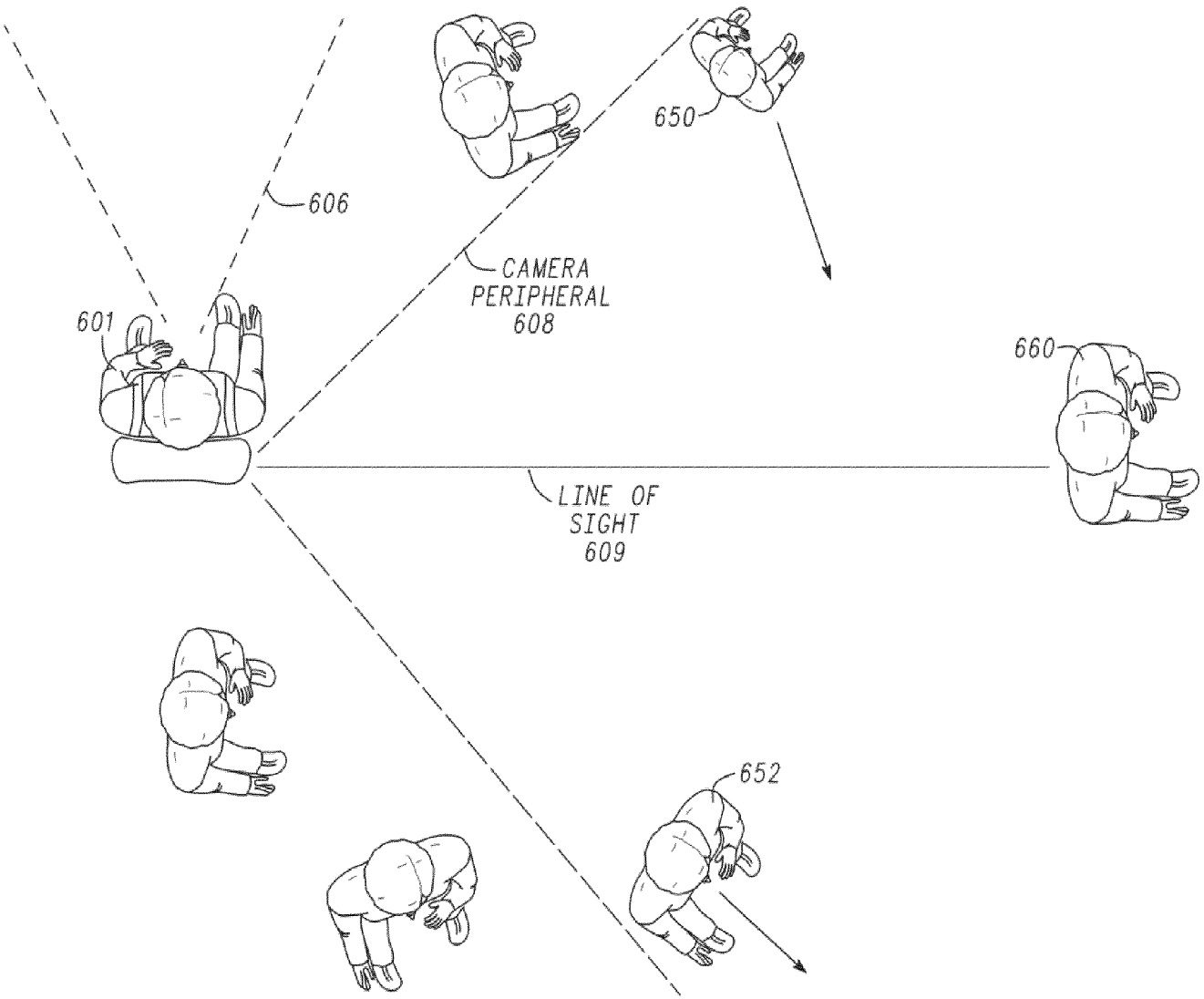
FIG. 6 depicts a diagram illustrating the identification of a clear line of sight to a target, according to an embodiment of the present invention.

FIG. 6 depicts a diagram illustrating the identification of a clear line of sight to a target, according to an embodiment of the present invention. In this example, an operator 601 is carrying a projectile launching apparatus in the form of a rucksack delivery system. The rucksack delivery system includes a missile tube and a projectile packed into the missile tube. The rucksack delivery system also includes a targeting system that includes a sighting device in the form of a targeting camera fixed affixed 90° from the facial line of sight 606 and in-line with the direction of ejection or launch of the projectile.

The operator 601 can initially aim the projectile at the target 660 by aligning himself perpendicular to the target 660. FIG. 6 depicts the camera peripheral 608 of the targeting camera and the line of sight 609 from the projectile to the target 660, as identified by the targeting system. In addition to sensing the target 660, the targeting system is also sensing other objects within the environment. For example, the targeting system is also sensing other people 650 and 652 within a vicinity of the target 660. Here, the vicinity is limited to the camera peripheral 608 of the targeting camera, but it should be appreciated that the targeting system may include other sensors that can expand the sensing area within the vicinity of the target 660.

In particular, the targeting system also senses directions and velocities of the people 650 and 652 within the vicinity of the target 660. As discussed above, the targeting system may identify an acceptable firing solution based, in part, on a clear line of sight 609 to the target 660. In this example, the targeting system identifies that the person 652 will not move into the line of sight 609 after the projectile is launched based on his velocity and direction, which is depicted in FIG. 6. At the same time, the targeting system identifies that the other person 650 will move into the line of sight 609 after the projectile is launched based on his velocity and direction, which is depicted in FIG. 6. If the projectile is launched with the person 650 moving in the same direction and speed, the targeting system projects that the projectile will strike the person 650 rather than the target 660. Accordingly, in this example, the targeting system identifies an unacceptable firing solution and signals to the operator 601 that the projectile cannot be launched. On the other hand, if the person 650 is moving in a direction opposite to the direction depicted in FIG. 6, then the targeting system may identify that the person 650 will not move into the line of sight 609 after the projectile is launched. Accordingly, the targeting system identifies an acceptable firing solution and signals to the operator 601 that the projectile can be launched.

Figure 7:
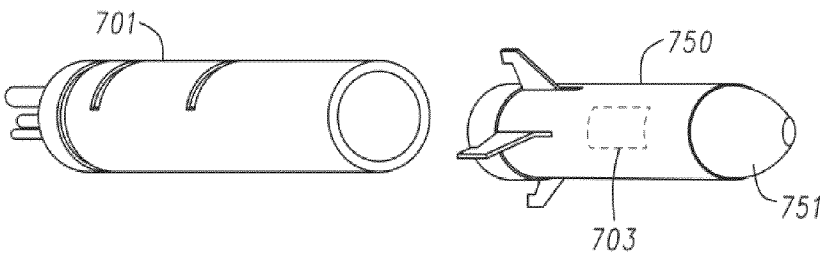
FIG. 7 depicts an example of a projectile launching apparatus, in accordance with one embodiment, configured to explode and release shrapnel before striking the target.

FIG. 7 depicts an example of a projectile launching apparatus 700, in accordance with one embodiment, configured to explode and release shrapnel before striking the target. As depicted, the projectile launching apparatus 700 includes a sabot 701 and a projectile 750 in the form of a rocket. In one embodiment, the projectile 750 is unguided. That is, the control surfaces (e.g., fins) of the projectile 750 do not guide the projectile during flight. In another embodiment, the projectile 750 may be guided. In this example, the projectile 750 includes an explosive and a fuse that is configured to trigger the explosive before striking a target. Additionally, in this embodiment, the projectile 750 may include a targeting system with a proximity sensor 751 located at the head of the projectile 750 and circuitry 703 configured to identify a firing solution to a target. The proximity sensor 751 refers to a variety of sensors that can sense measurements associated with objects, as discussed above.

The projectile 750 is coupled to the sabot 701. The sabot 701 is a device included in the projectile launching apparatus 700 that is used to launch, fire, or eject the projectile 750. In one embodiment, the sabot 701 may be in the form of a tube with openings at both ends. In another embodiment, as depicted in FIG. 7, the sabot 701 may be a cup sabot, which is a device that surrounds the base and sides of the projectile 750. In yet another embodiment, the sabot 701 may be a spindle sabot, which includes a set of matched rings having a center section in contact with the projectile 750. As explained in more detail below, a sighting device (not shown) may additionally be coupled to the sabot 701.

Depending on the design and type of sabot 701, the projectile 750 can be coupled to it in a variety of different ways. In the example of a cup sabot, the projectile 750 may be fitted within the cup sabot. In another example, the projectile 750 may be mounted on top of the sabot 701. The sabot 701 ejects or launches the projectile 750 using a variety of different ejection mechanisms. In one embodiment, the ejection can be in the form of a propulsion system derived from commercial airbag technology. Such a propulsion pressure is funneled to the sabot 701 and the energy is transferred to the projectile 750, thereby ejecting the projectile 750 from the sabot 701. In an alternate embodiment, the ejection can be in the form of a booster charge comprised of gunpowder or other explosives.

Figure 8:
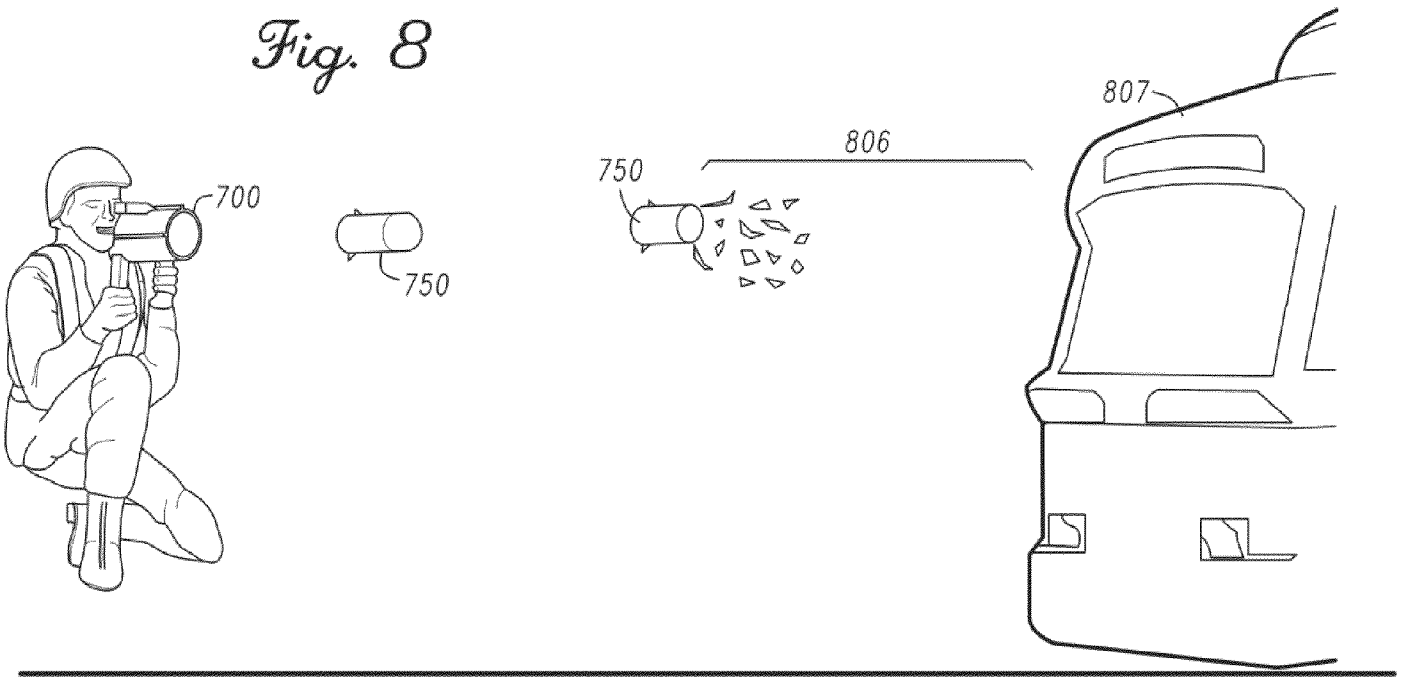
FIG. 8 depicts a time-elapsed diagram illustrating a deployment of a projectile that is configured to explode before striking the target, consistent with an embodiment of the present invention.

FIG. 8 depicts a time-elapsed diagram illustrating a deployment of a projectile 750 that is configured to deploy an explosive before striking the target 807, consistent with an embodiment of the present invention. As depicted at 802, an operator carries the projectile launching apparatus 700 for launching a projectile 750. In this example, this operator identifies a target 807 in the form of a vehicle and aims the projectile launching apparatus 700 at the target 807. While the target 807 is within the line of sight, the targeting system included in the projectile launching apparatus 700 senses, for example, a distance to the target 807, an elevation of the target 807, a height of the target 807, and an angle of the projectile 750 before launch.

Additionally, the targeting system may also identify a deployment distance 806, in accordance with an embodiment. As used herein, a "deployment distance," refers to a distance from the target 807 to the projectile 750 at an instance of deployment of some object after the projectile 750 has launched. A variety of objects may be deployed by the projectile 750. In this example, the projectile 750 may deploy an explosive at the deployment distance 806. In another example, as explained in more detail below, the projectile 750 may deploy a piece of multilayered fabric at the deployment distance 806. The deployment distance 806 may be predefined or preset. In an alternate embodiment, the targeting system can dynamically adjust the deployment distance 806 based on a variety of measurements and other information, such as the distance to, altitude of, and height of the target 807.

Based on the various measurements and information as described above (including the deployment distance 806), the targeting system identifies an acceptable firing solution and signals to the operator that the projectile 750 can be launched. As a result, the operator launches the projectile 750 and, as depicted at 808, the projectile 750 deploys an explosive at the deployment distance 806 before the projectile 750 strikes the target 807. The explosive is configured to explode shortly upon deployment, which results in the deployment of shrapnel onto the target 807, thereby destroying the target 807.

Figure 9:
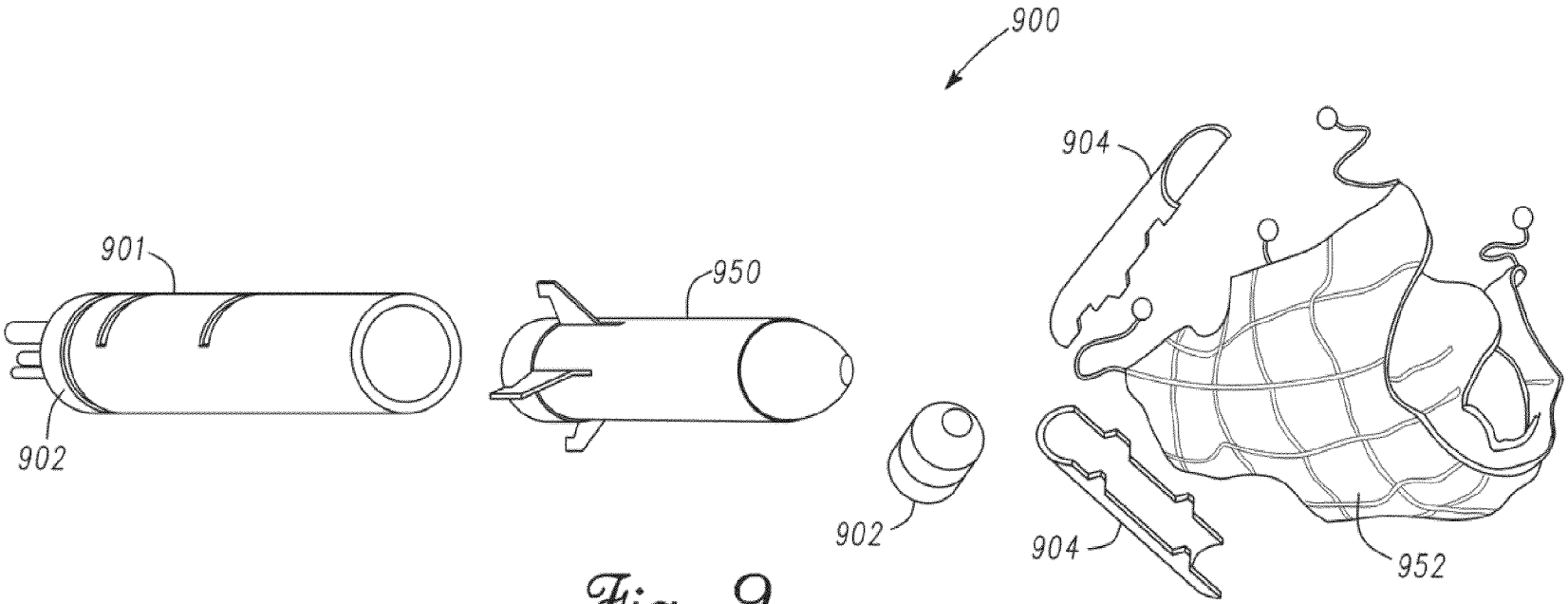
FIG. 9 depicts another embodiment of a projectile launching apparatus, in accordance with one embodiment, configured to contain projectiles from an explosion of an explosive device carried by a person.

FIG. 9 depicts another embodiment of a projectile launching apparatus 900, in accordance with one embodiment, configured to contain projectiles from an explosion of an explosive device carried by a person. The entrapment system 900 includes a sabot 901 and a projectile 950. In this embodiment, the projectile 950 includes a casing 904 and a piece of multilayered fabric 952 packed into the casing 904. Additionally, the projectile 950 may include a proximity sensor 902 coupled to the casing 904 and a pyrotechnic device (not shown) coupled to the casing 904. In this embodiment, the targeting system includes circuitry 960, which is configured to identify a firing solution, and a proximity sensor 902. The circuitry 960 is part of the sabot 901 while the proximity sensor 902 is coupled to the casing 904 and, in this example, may be located at a front end of the projectile 950. The proximity sensor 902 is electrically coupled to the pyrotechnic device and coupled to the circuitry 960, and senses and transmits various measurements to the circuitry 960.

As illustrated in FIG. 9, at a certain deployment distance, the proximity sensor 902 is configured to trigger an explosion of the pyrotechnic device. This explosion breaks apart or opens the casing 904 in order to deploy the piece of multilayered fabric 952. The piece of multilayered fabric 952 is deployed before the projectile 950 strikes the target. Once deployed, the piece of multilayered fabric 952 is configured to unfold or spread out and to wrap around a person having an explosive device. It should be appreciated that the piece of multilayered fabric 952 is a mesh material that comprises openings, which are configured to vent the over pressure force resulting from the explosion. When wrapped around a person carrying an explosive device, the piece of multilayered fabric 952 can contain projectiles from an explosion of the explosive device.

Figure 10:
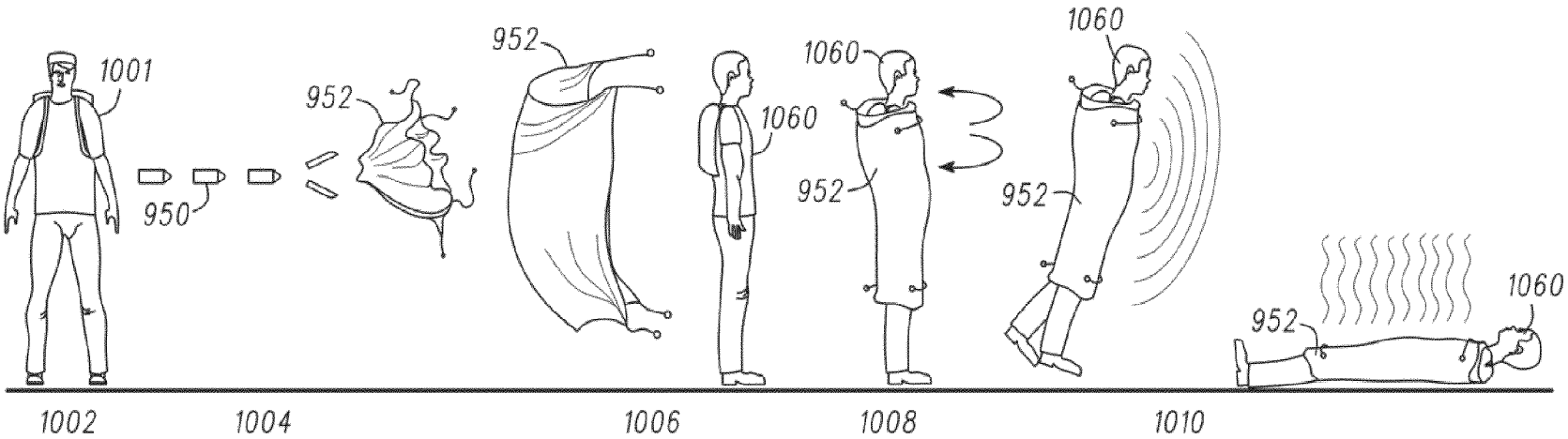
FIG. 10 depicts a time-elapsed diagram illustrating a deployment of the piece of multilayered fabric, according to one embodiment of the present invention.

FIG. 10 depicts a time-elapsed diagram illustrating a deployment of the piece of multilayered fabric 952, according to one embodiment of the present invention. As depicted at 1002, an operator 1001 carries a projectile launching apparatus included in a rucksack for launching projectile 950. In this example, the operator 1001 identifies a target 1060 (a person) carrying an explosive device, and aims the projectile launching apparatus at the target 1060. While the target 1060 is within the line of sight, the proximity sensor senses various measurements associated with the target 1060, and the targeting system identifies an acceptable firing solution based on the sensed measurements and other information. With the acceptable firing solution identified, the targeting system signals to the operator 1001 that the projectile can be launched and accordingly, the operator 1001 launches the projectile 950 towards the target 1060.

In this example, the projectile 950 includes a casing and a piece of multilayered fabric 952 packed into the casing, as discussed above. After the projectile 950 is launched, as depicted at 1004, the casing of the projectile 950 breaks apart at a certain deployment distance from the target 1060 to release and deploy the piece of multilayered fabric 952. As depicted at 1006, once deployed, the piece of multilayered fabric 952 is configured to unfold or spread out and, as depicted at 1008, to wrap around the target 1060 having the explosive device. When wrapped around the target 1060, the piece of multilayered fabric 952 can contain projectiles (shrapnel) from an explosion of the explosive device, as depicted at 1010, and thus minimize casualties. In addition to containing projectiles from the explosion, the piece of multilayered fabric 962 may further immobilize the target 1060 and therefore, provide a nonlethal alternative to neutralize the target 1060.

It should be appreciated that certain embodiments are described herein as including logic or a number of components, modules, or mechanisms. Modules may constitute either software modules (e.g., code embodied on a machine-readable medium or in a transmission signal) or hardware modules. A hardware module is a tangible unit capable of performing certain operations and may be configured or arranged in a certain manner. In example embodiments, one or more computing devices or one or more hardware modules of a computing device (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may, for example, be driven by cost and time considerations.

Accordingly, the term "hardware module" should be understood to encompass a tangible entity, be that an entity that is physically constructed, permanently configured (e.g., hardwired) or temporarily configured (e.g., programmed) to operate in a certain manner and/or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Furthermore, modules can provide information to, and receive information from, other hardware modules. For example, the described hardware modules may be regarded as being communicatively coupled. Where multiples of such hardware modules exist contemporaneously, communications may be achieved through signal transmission (e.g., over appropriate circuits and buses) that connect the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation, and store the output of that operation in a memory device to which it is communicatively coupled. A further hardware module may then, at a later time, access the memory device to retrieve and process the stored output. Hardware modules may also initiate communications with input or output devices, and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment or as a server farm), while in other embodiments the processors may be distributed across a number of locations.

While the embodiment(s) is (are) described with reference to various implementations and exploitations, it will be understood that these embodiments are illustrative and that the scope of the embodiment(s) is not limited to them. In general, techniques identifying firing solutions may be implemented with facilities consistent with any hardware system or hardware systems defined herein. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the embodiment(s). In general, structures and functionality presented as separate components in the exemplary configurations may be implemented as a combined structure or component. Similarly, structures and functionality presented as a single component may be implemented as separate components. These and other variations, modifications, additions, and improvements fall within the scope of the embodiment(s).

What is claimed is:

1. A method of identifying a firing solution to a target, the method comprising:

sensing an elevation of the target relative to an initial height of the projectile;

sensing a height of the target between upper and lower points of the target;

sensing a clear line of sight from the projectile to the target;

sensing a distance from a projectile to the target;

identifying an angle of the projectile before launching the projectile;

designating a propulsion impulse for the projectile before launching the projectile and identifying a velocity of the projectile upon launching based on the designated propulsion impulse;

identifying an acceptable firing solution based on the elevation, the height, the clear line of sight and at least one of the distance, the angle or the velocity; and signaling that the projectile can be launched based on the identification of the acceptable firing solution.

2. The method of claim 1, wherein the sensing of the clear line of sight comprises:

identifying a line of sight from the projectile to the target;

sensing a direction and a velocity of an object within a vicinity of the target; and identifying that the object will not move into the line of sight after the projectile is launched.

3. The method of claim 1, wherein the identification of the velocity of the projectile comprises identifying a propulsion system impulse to be applied to the projectile based on the distance.

4. The method of claim 1, wherein the distance is between about 25 to about 200 meters.

5. The method of claim 1, wherein the projectile includes an object packed into the projectile, the method further comprising identifying a deployment distance from the target to the projectile at an instant of a deployment of the object after the projectile has launched, and wherein the identification of the acceptable firing solution is additionally based on the deployment distance.

6. The method of claim 1, further comprising sensing a velocity of the target, and wherein the identification of the acceptable firing solution is additionally based on the velocity.

7. The method of claim 1, wherein the projectile is unguided.

8. The targeting system of claim 1 wherein designating the propulsion value for the projectile before launching includes designating the propulsion value according to the distance from the projectile to the target.

9. A projectile launching apparatus comprising:

a sabot; and a targeting system coupled to the sabot, the targeting system comprising:

a sensor configured to sense an elevation of the target relative to an initial height of a projectile, a height of the target between upper and lower points of the target, and a line of sight from the projectile to the target;

a trajectory calculation module in communication with the safe-to-fire calculation module, the trajectory calculation module configured to identify an angle of the projectile before launching the projectile;

a propulsion designation module in communication with the safe-to-fire calculation module; and a safe-to-fire calculation module in communication with the sensor, the safe-to-fire calculation module configured to identify an acceptable firing solution based on the elevation, the height, the line of sight, and at least one of the distance, angle or velocity, and to signal that the projectile can be launched based on the identification of the acceptable firing solution, and the safe-to-fire calculation module is configured to identify the velocity upon launching of the projectile according to a propulsion impulse designated with the propulsion designation module.

10. The projectile launching apparatus of claim 9, wherein the propulsion designation module is configured to identify the velocity based on identifying a propulsion system impulse to be applied to the projectile based on at least one of the distance, the elevation, or the height.

11. The projectile launching apparatus of claim 9, wherein the projectile includes a piece of multilayered fabric packed into the projectile, the piece of multilayered fabric, when deployed after the projectile has launched, is configured to wrap around the target.

12. The projectile launching apparatus of claim 9, wherein the piece of multilayered fabric is deployed before the projectile strikes the target, and wherein the trajectory calculation module is further configured to identify a deployment distance from the target to the projectile, and wherein the safe-to-fire calculation module is configured to identify the acceptable firing solution based additionally on the deployment distance.

13. The projectile launching apparatus of claim 9, wherein the projectile includes an explosive, the trajectory calculation module is further configured to identify a deployment distance from the target to the projectile to deploy the explosive, and wherein the safe-to-fire calculation module is configured to identify the acceptable firing solution based additionally on the deployment distance.

14. A targeting system comprising:

at least one processor;

a sensor in communication with the at least one processor, the sensor configured to:

sense an elevation of the target relative to an initial height of a projectile, a height of the target between upper and lower points of the target, and a line of sight from the projectile to the target, and sense a distance from the projectile to the target, and a memory in communication with the at least one processor, the memory being configured to store a propulsion designation module, a trajectory calculation module, a propulsion designation module, and a safe-to-fire calculation module that are executable by the at least one processor, the trajectory calculation module having instructions that when executed by the at least one processor, cause operations to be performed, the operations comprising identifying an angle of the projectile before launching the projectile, the propulsion designation module having instructions that when executed by the at least one processor, cause operations to be performed, the operations comprising identifying a velocity of the projectile upon launching the projectile, and the safe-to-fire calculation module having instructions that when executed by the at least one processor, cause operations to be performed, the operations comprising identifying an acceptable firing solution based on the elevation, the height, the line of sight, and at least one of the distance, the angle, or the velocity and signaling that the projectile can be launched based on the identification of the acceptable firing solution.

15. The targeting system of claim 14, wherein the sensor is further configured to sense an object within a vicinity of the target, and wherein the safe-to-fire calculation module has instructions that when executed by the at least one processor, cause operations to be performed, the operations further comprising:

identifying a direction and a velocity of the object; and identifying that the object will not move into the line of sight after the projectile is launched.

16. The targeting system of claim 14, wherein the operation of identifying the velocity of the projectile comprises identifying a propulsion system impulse to be applied to the projectile based on the distance.

17. The targeting system of claim 14, wherein the projectile includes an object packed into the projectile, wherein the safe-to-fire calculation module has instructions that when executed by the at least one processor, cause operations to be performed, the operations further comprising identifying a deployment distance from the target to the projectile at an instant of a deployment of the object after the projectile has launched, and wherein the operation of identifying the acceptable firing solution is additionally based on the deployment distance.

18. The targeting system of claim 17, wherein the object is a piece of multilayered fabric.

19. The targeting system of claim 17, wherein the object is an explosive.

20. The targeting system of claim 14, wherein the target is a person.

* * * * *

UNITED STATES PATENT AND TRADEMARK OFFICE

CERTIFICATE OF CORRECTION

PATENT NO. : 8,157,169 B2
APPLICATION NO. : 12/610498
DATED : April 17, 2012
INVENTOR(S) : Thomas A. Olden et al.

It is certified that error appears in the above-identified patent and that said Letters Patent is hereby corrected as shown below:

In the Claims:

In column 12, line 43, in Claim 8, delete “targeting system” and insert -- method --, therefor.

In column 13, line 38, in Claim 14, delete “target,” and insert -- target; --, therefor.

Signed and Sealed this
Fourth Day of December, 2012

David J. Kappos

David J. Kappos
*Director of the United States Patent and Trademark Office*